US005611460A

United States Patent [19]

Rudell

[11] Patent Number: 5,611,460

[45] Date of Patent: Mar. 18, 1997

[54] WATER SHIELD WITH INTEGRAL SQUIRTING DEVICE

[76] Inventor: Elliot Rudell, 1619 Gramercy Ave., Torrance, Calif. 90501

[21] Appl. No.: 573,369

[22] Filed: Dec. 15, 1995

[51] Int. Cl.[6] ..... B67D 5/10

[52] U.S. Cl. ..... 222/78; 222/192

[58] Field of Search ..... 222/78, 79, 192; 273/349

[56] References Cited

U.S. PATENT DOCUMENTS

| | | | |
|---|---|---|---|
| 4,890,767 | 1/1990 | Burlison | 222/78 |
| 4,932,912 | 6/1990 | Combs | 222/78 X |
| 5,065,904 | 11/1991 | McCaffrey et al. | 222/78 X |
| 5,435,569 | 7/1995 | Zilliox | 273/349 |

*Primary Examiner*—Gregory L. Huson

*Attorney, Agent, or Firm*—Blakely Sokoloff Taylor & Zafman

[57] ABSTRACT

A water emitting toy that includes a toy shield which deflects water directed at the end user of the toy. The shield is coupled to a nozzle, a pump and a fluid reservoir. The toy also has a trigger that can be depressed to emit a stream of water from the nozzle. The nozzle, pump and reservoir can be incorporated into the toy shield so that the shield both emits water and deflects an incoming stream of water. The toy shield preferably has a transparent window so that the end user can view the opponent while protecting the user's head. As an alternate embodiment, the pump and nozzle may be incorporated into a separate gun unit that is coupled to a reservoir located within the shield. The end user can emit a stream of water with the toy gun while deflecting water with the shield. As another embodiment, the shield may be constructed as a toy accessory which snaps onto an existing toy water gun.

15 Claims, 3 Drawing Sheets

WATER SHIELD WITH INTEGRAL SQUIRTING DEVICE

BACKGROUND OF THE INVENTION

1. Field of the Invention

The present invention relates to a toy water gun.

2. Description of Related Art

Toy water guns have been marketed and sold for many years. Prior art water guns typically contain a manually operated pump located within a plastic housing that is molded in the shape of a gun. The pump is coupled to a reservoir that is located within the housing and which can be filled with water by the end user. The toy gun typically has a trigger that can be manipulated by the end user to pressurize the water and emit a water stream from a nozzle located at the end of the housing.

Entertech Corp. has produced a line of battery operated toy water guns that contain an electric pump. The Entertech product provides improved play action and is sold at a price point that justified television promotion, thereby greatly increasing the public visibility of toy water guns.

U.S. Pat. No. 5,074,437, assigned to Larami Toys discloses a toy water gun that is marketed under the trademark SUPER SOAKER. The SUPER SOAKER gun contains a removable fluid reservoir which can be filled with water and pressurized with an integral manually operated piston. The Larami product creates a large volume of highly pressurized water which greatly increased the range of existing water guns.

There has been marketed a water emitting toy by Captoys under the trademark SHOUT N SHOOT which includes a head band that is coupled to a microphone and an earpiece. The head band is coupled to a fluid reservoir typically worn on the belt of the end user. The SHOUT N SHOOT product also contains an electric pump which is activated by shouting into the microphone. Activating the pump, pressurizes the fluid and emits a stream of water from a nozzle located within the head band.

Although there have been many commercially successful toy water gun products, there has never been a water emitting toy that deflects and shields the end user from an on-coming stream of water. It would be desirable to provide a water emitting toy that also shields the end user from an opponent's water stream.

SUMMARY OF THE INVENTION

The present invention is a water emitting toy that includes a toy shield which deflects water directed at the end user of the toy. The shield is coupled to a nozzle, a pump and a fluid reservoir. The toy also has a trigger that can be depressed to emit a stream of water from the nozzle. The nozzle, pump and reservoir can be incorporated into the toy shield so that the shield both emits water and deflects an incoming stream of water. The toy shield preferably has a transparent window so that the end user can view the opponent while protecting the user's head. As an alternate embodiment, the pump and nozzle may be incorporated into a separate gun unit that is coupled to a reservoir located within the shield. The end user can emit a stream of water with the toy gun while deflecting water with the shield. As another embodiment, the shield may be constructed as a toy accessory which snaps onto an existing toy water gun.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
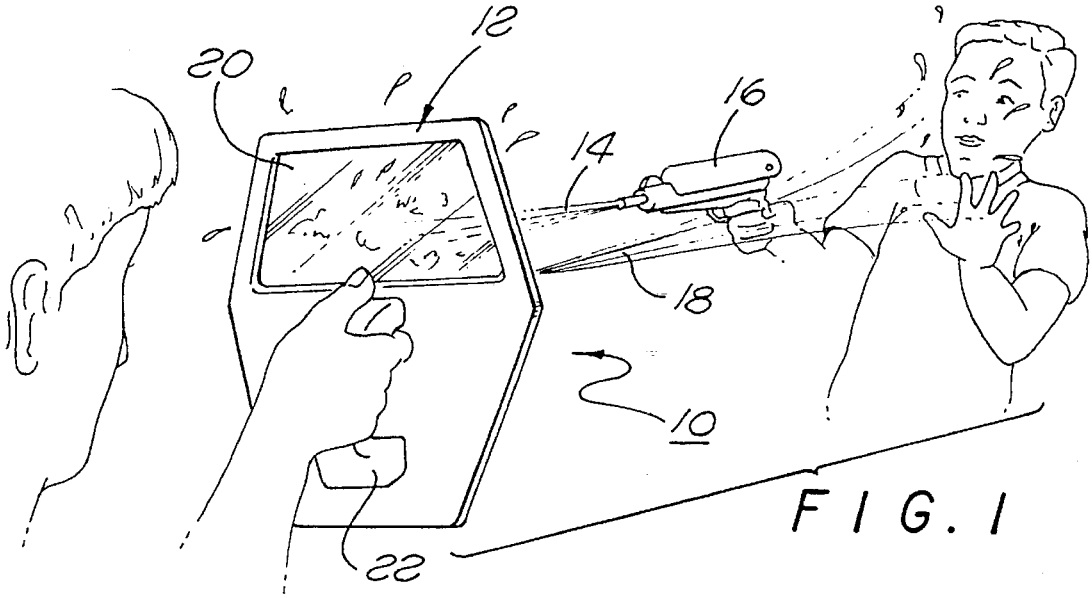
FIG. 1 is a perspective view of a water emitting toy of the present invention.

Referring to the drawings more particularly by reference numbers, FIG. 1 shows a water emitting toy 10 of the present invention. The toy 10 includes a toy shield 12 that can deflect a water stream 14 sprayed at the end user from a water gun 16 held by an opponent. The toy 10 of the present invention also emits a stream of water 18 that can be directed onto the opponent. The toy 10 of the present invention can thus "fire" at an opponent while deflecting water "fired" at the end user by the opponent. The opponent becomes soaked by the water emitted from the toy 10 because the conventional gun 16 held by the opponent does not deflect the water stream 18.

The shield 12 preferably contains a transparent window 20 that allows the end user to see the opponent while protecting his head. As an alternate embodiment, the entire shield 12 may be constructed from a transparent material. The toy 10 may also have a handle 22 that allows the end user to more easily hold the shield 12. The shield 12 is typically constructed to have a flat outer surface.

Figure 2:
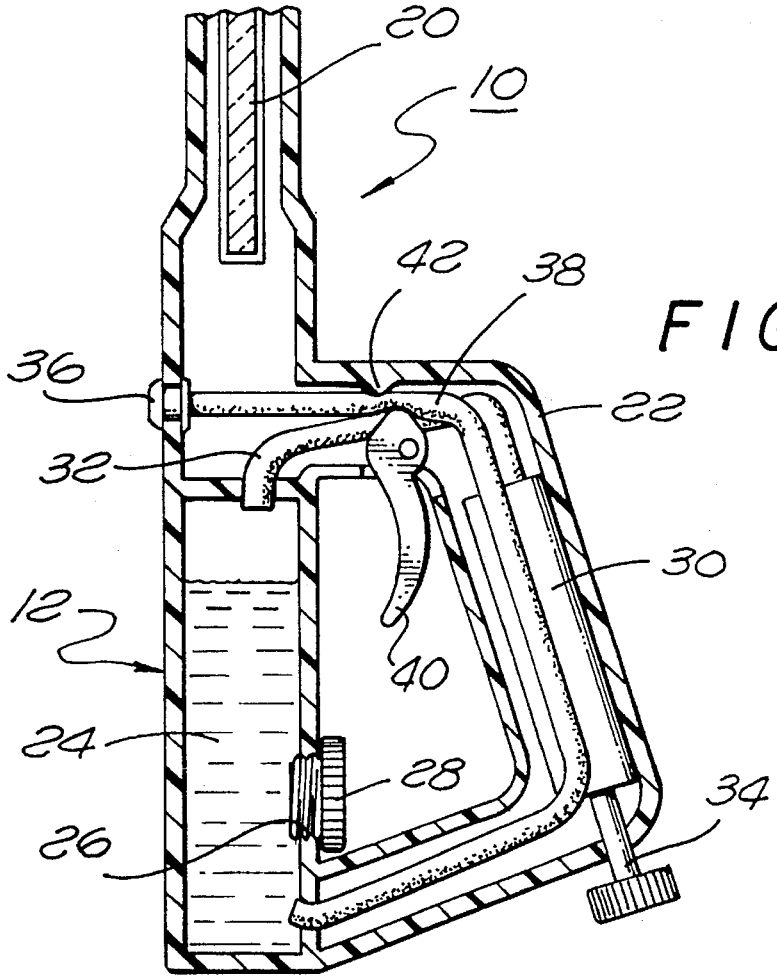
FIG. 2 is a cross-sectional view of the water emitting toy.

As shown in FIG. 2 the toy 10 includes a fluid reservoir 24 located within the shield 12. The end user can fill the reservoir 24 with water through a port 26 that is closed by a fill cap 28. The fluid reservoir 24 is coupled to a pump 30 by a tube 32. The pump 30 is preferably located within the handle 22 to minimize the size of the product. The pump 30 may have a piston 34 that can be manipulated to pressurize the water within the reservoir 24. Alternatively, the pump 30 may have an electric motor which pressurizes the water within the reservoir 24. As another alternate embodiment, the toy may have an internal flexible tube instead of the pump. The elastic properties of the tube exert a pressure on the water which will push the water out of the tube. Such a tube is disclosed in U.S. Pat. No. 5,173,175, which is hereby incorporated by reference.

The reservoir 24 is coupled to a nozzle 36 by another tube 38. The flow of water from the reservoir 24 to the nozzle 36 is controlled by a trigger 40. The trigger 40 pinches the tube 38 into an inner protrusion 42 of the handle 22 to prevent water from flowing into the nozzle 36. The trigger 40 can be rotated by the end user to open the tube 38 and allow water to flow out of the nozzle 36. The trigger 40 may have a spring (not shown) that normally biases the trigger 40 into the closed position. The nozzle 36 is preferably attached to the outer-wall of the shield 12 so that the toy emits a water stream from the outer surface of the toy 10.

The toy 10 can be operated by initially filling the reservoir 24 with water and then sliding the piston 34 in a reciprocating motion to pressurize the water. The end user can then depress the trigger 40 to allow the pressurized water to flow from the reservoir 24 to the nozzle 36 and from the shield 12 as a stream of water. The end user can spray an opponent while deflecting water directed at the user.

Figure 3:
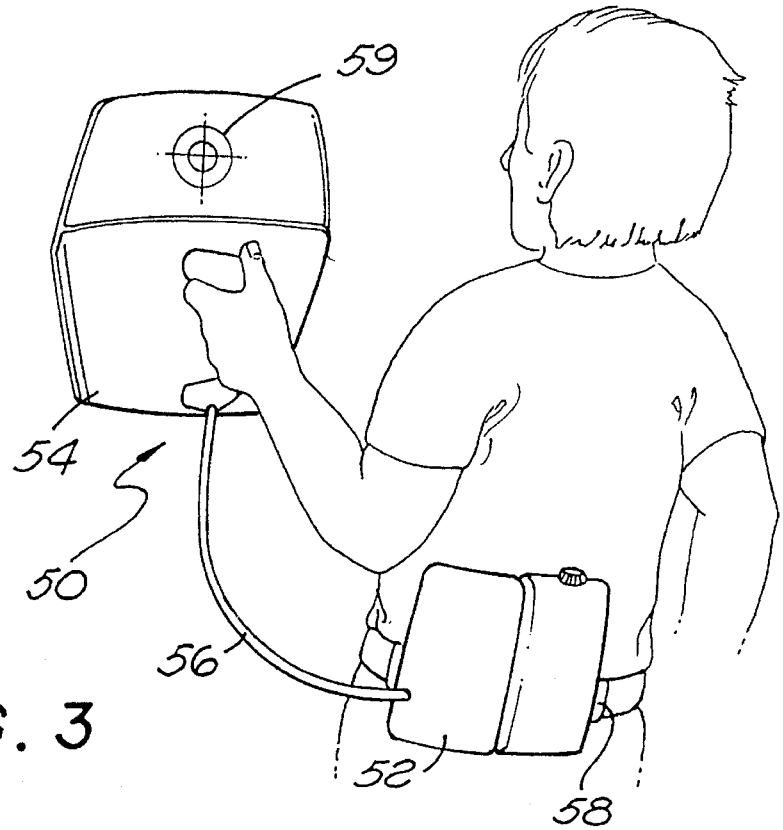
FIG. 3 is an alternate embodiment of the water emitting toy.

FIG. 3 shows an alternate embodiment of a water emitting toy 50 which has a fluid reservoir 52 that is coupled to a shield 54 by a tube 56. The fluid reservoir 52 may have loops 58 or other means for attaching the reservoir 52 to a belt of the end user. The toy 50 may have a primary reservoir located within the shield 54, wherein the external reservoir 52 provides an auxiliary supply of fluid. The pump may be located within the shield 54, or the reservoir 52. The shield 54 may include target indicia 59 that corresponds to the range of the water stream emitted by the toy. The shield 54 is preferably constructed from a transparent material so that the end user can look through the toy and align an opponent with the target indicia 59.

Figure 4:
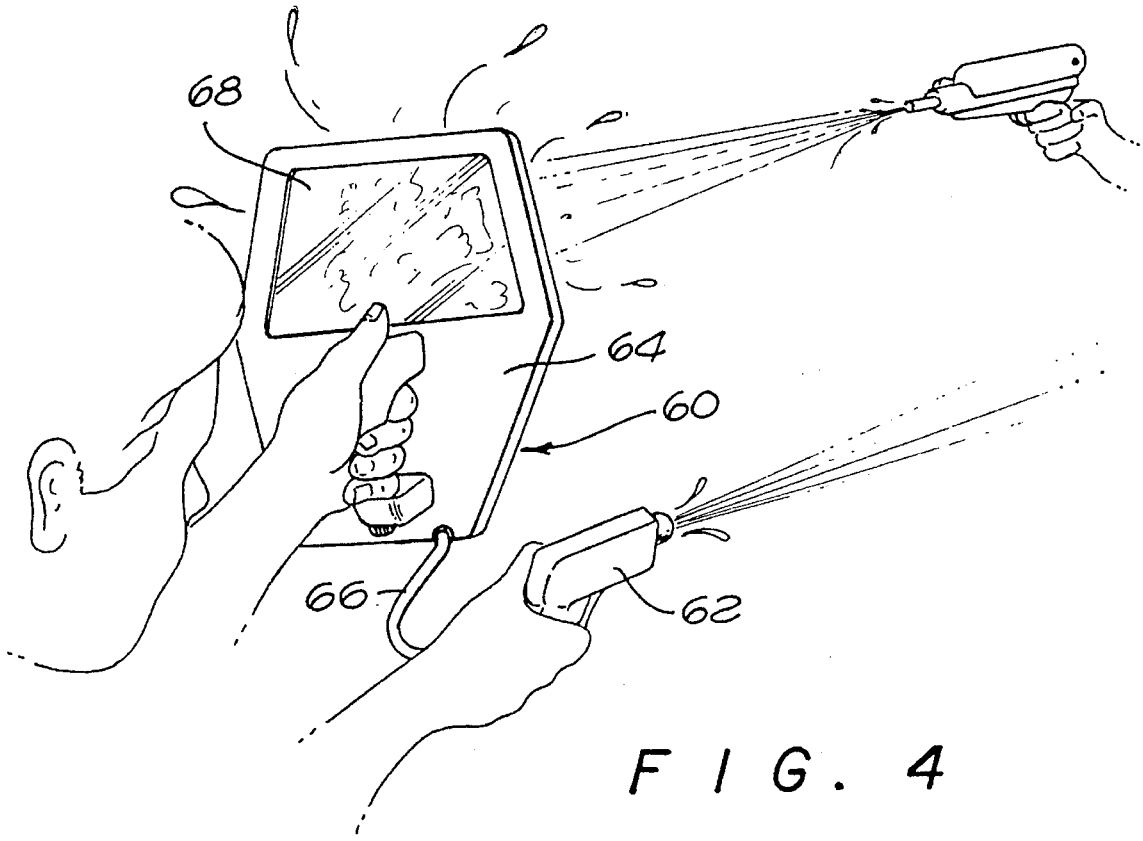
FIG. 4 is an alternate embodiment of the water emitting toy.

FIG. 4 shows an alternate embodiment of a water emitting toy 60 which has a toy gun 62 that is coupled to a shield 64 by a tube 66. The gun 62 may contain a nozzle and a pump so that the end user can squirt water from the gun 62 while deflecting water with the shield 64. The shield 64 may contain the fluid reservoir. Alternatively, the shield may contain the reservoir and the pump. Additionally, the gun 62 may contain a reservoir such that the shield 64 provides an auxiliary source of water. The toy shield 64 preferably contains a transparent window 68 that allows the end user to look through the shield 64.

Figure 5A:
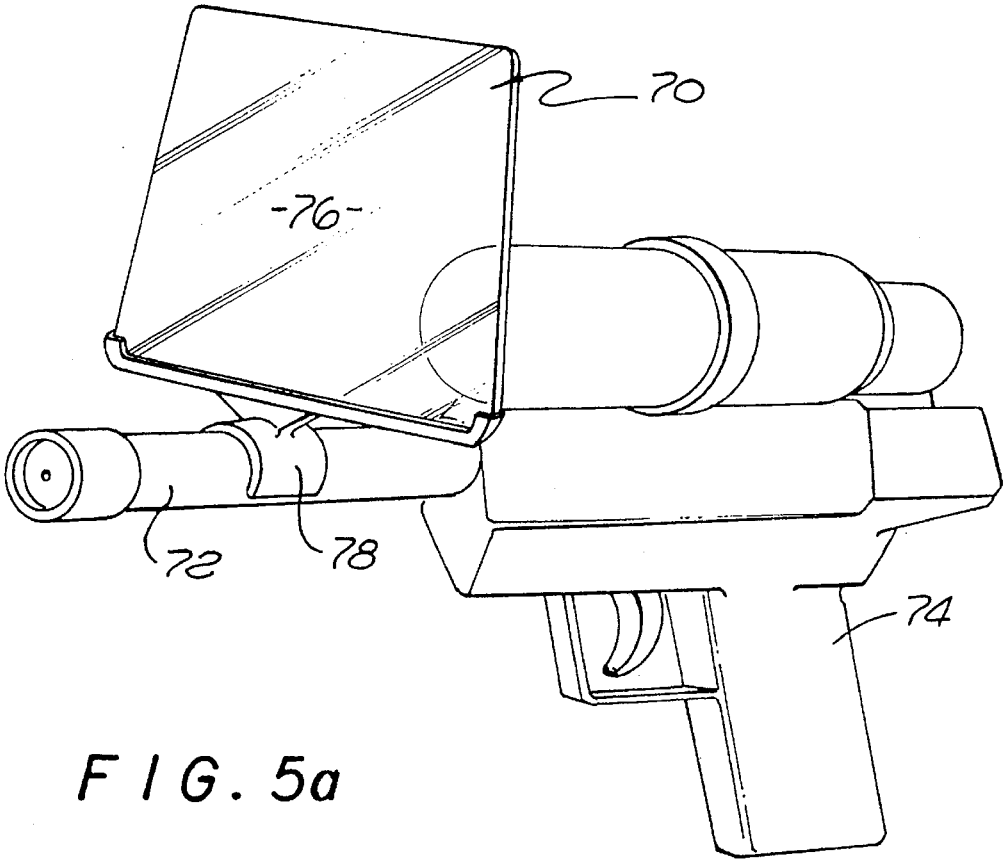
FIG. 5*a* is an alternate embodiment of a toy shield that can be attached to an existing toy water gun.
Figure 5B:
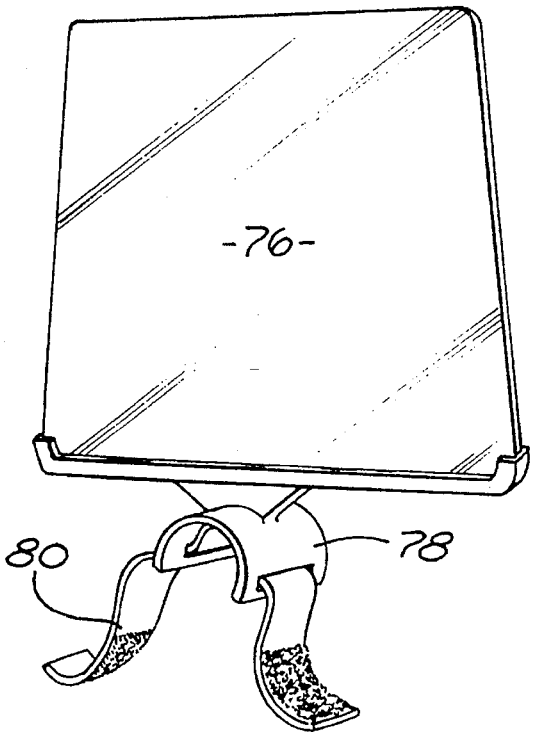
FIG. 5*b* is an alternate embodiment of the toy shield.

FIG. 5*a* shows an alternate embodiment of a toy shield 70 that can be attached to the barrel 72 of an existing toy water gun 74. The shield 70 includes a transparent window 76 that extends from a clip 78. The clip 78 can be snapped onto the toy gun barrel 72. As shown in FIG. 5*b*, the shield 70 may also have a pair of straps 80 that can secure the clip 78 to the toy gun barrel 72. The straps 80 may have hook and loop material to secure the strap ends. The shield 70 provides a toy accessory that can be attached to an existing toy water gun to deflect incoming water from an opponent.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A fluid emitting toy, comprising:

a shield which has a first surface and a second surface;

a handle attached to said second surface of said shield;

a nozzle attached to said first surface of said shield;

a pump coupled to said nozzle; and, a fluid reservoir coupled to said pump.

2. The toy as recited in claim 1, wherein said pump is integrally connected to said shield.

3. The toy as recited in claim 2, wherein said fluid reservoir is located within said shield.

4. The toy as recited in claim 1, wherein said shield includes a transparent window.

5. The toy as recited in claim 2, further comprising a tube that couples said pump to said fluid reservoir, wherein said fluid reservoir is separate from said shield.

6. The toy as recited in claim 1, further comprising a tube that couples said pump and said nozzle to said fluid reservoir, wherein said fluid reservoir is located within said shield.

7. The toy as recited in claim 1, wherein said shield has a trigger that controls a flow of fluid emitted from said nozzle.

8. The toy as recited in claim 1, wherein said pump includes a manually operated piston.

9. The toy as recited in claim 1, wherein said pump includes an electric motor which pressurizes a fluid within said fluid reservoir.

10. A fluid emitting toy, comprising:

a shield which has a first surface and a second surface, said shield having a transparent window and a handle that extends from said second surface;

a nozzle that is attached to said shield and emits fluid from said first surface;

a pump that is coupled to said nozzle and located within said shield; and, a fluid reservoir coupled to said pump.

11. The toy as recited in claim 10, wherein said fluid reservoir is located within said shield.

12. The toy as recited in claim 10, further comprising a tube that couples said fluid reservoir to said pump.

13. The toy as recited in claim 11, wherein said shield has a handle, and a trigger that controls a flow of fluid emitted from said nozzle.

14. The toy as recited in claim 13, wherein said pump includes a manually operated piston.

15. The toy as recited in claim 13, wherein said pump includes an electric motor which pressurizes a fluid within said fluid reservoir.

* * * * *